US007179064B2

(12) United States Patent
Folchert

(10) Patent No.: US 7,179,064 B2
(45) Date of Patent: Feb. 20, 2007

(54) RECIPROCATING PISTON COMPRESSOR FOR A GASEOUS MEDIUM

(75) Inventor: Uwe Folchert, Lauenau (DE)

(73) Assignee: Continental Aktiengesellschaft, Hannover (DE)

( * ) Notice: Subject to any disclaimer, the term of this patent is extended or adjusted under 35 U.S.C. 154(b) by 615 days.

(21) Appl. No.: 10/652,473

(22) Filed: Sep. 2, 2003

(65) Prior Publication Data

US 2004/0042919 A1 Mar. 4, 2004

(30) Foreign Application Priority Data

Aug. 31, 2002 (EP) ..... 02019521

(51) Int. Cl.
*F04B 17/00* (2006.01)

(52) U.S. Cl. ..... 417/415; 92/172

(58) Field of Classification Search ..... 417/415, 417/273, 545, 569; 92/140, 240
See application file for complete search history.

(56) References Cited

U.S. PATENT DOCUMENTS 2,023,466 A * 12/1935 Crowley ..... 417/489
4,848,213 A * 7/1989 Wood et al. ..... 92/172
5,378,123 A * 1/1995 Scuderi et al. ..... 417/415
5,531,574 A * 7/1996 Honma ..... 417/415
5,733,108 A * 3/1998 Riffe ..... 417/542

FOREIGN PATENT DOCUMENTS

DE 199 03 025 12/2001
DE 100 05 929 1/2002

* cited by examiner

*Primary Examiner*—Ehud Gartenberg
*Assistant Examiner*—Vikansha Dwivedi

(57) ABSTRACT

A reciprocating piston compressor for a gaseous medium is provided having a reduced structural height. The compressor is especially for a level control system in a motor vehicle. The maximum pivot angle of the piston ring longitudinal axis relative to the longitudinal axis of the cylinder running path is smaller during the upward movement of the piston than for the downward movement of the piston. The longitudinal axis of the cylinder running path is offset relative to the first spatial axis.

5 Claims, 6 Drawing Sheets

RECIPROCATING PISTON COMPRESSOR FOR A GASEOUS MEDIUM

FIELD OF THE INVENTION

The invention relates to a reciprocating piston compressor for a gaseous medium with the compressor having a reduced elevation for installation as a component in motor vehicles.

BACKGROUND OF THE INVENTION

A reciprocating piston compressor of the above kind is disclosed in German patent 199 03 025. The reciprocating piston compressor disclosed in this patent is for a gaseous medium and includes a piston movable within a cylinder. An end of the piston lies outside of the cylinder and is connected to the drive shaft of an electric motor. The reciprocating piston compressor and the drive unit are mounted in a compressor housing and a drive unit housing. A tubularly-shaped projection piece configured as one piece with the compressor housing is arranged on the compressor housing in the region of the piston. The compressor housing and the drive unit housing are configured as one piece. The reciprocating piston compressor known from this patent is configured in the conventional manner and has the disadvantage of needing substantial space for mounting and has the further disadvantage that there is high friction of the piston ring on the cylinder running path especially during the intake stroke.

A reciprocating piston compressor is also known from German patent 100 05 929 which drives a piston machine via a drive motor. A work chamber of the cylinder has a volume which pulsates between a smallest and a largest value. Inlet and outlet openings are provided with inlet and outlet elements, respectively. A medium is pushed through via the inlet and pushed out via the outlet with the inlet and outlet openings being separate. A crankshaft space is surrounded by a crankcase housing and is connected upstream of the work chamber of the cylinder. The crankshaft space is connected to the ambient via an intake support closeable by means of an air inlet valve. The air inlet valve is a rotation valve and is controllable in synchronism to the rotational movement of the crankshaft. An intake filter is integrated into the intake support and is connected ahead of the rotation valve. The intake support, the intake filter and the rotation valve form a single component. The reciprocating piston compressor known from German patent 100 05 929, which is configured in the conventional manner, also has the disadvantage of having a large construction and high friction of the piston ring on the cylinder running path especially during the intake stroke.

SUMMARY OF THE INVENTION

It is an object of the invention to provide a reciprocating piston compressor having a reduced structural elevation and a reduced friction of the piston ring on the cylinder traveling or running path.

The reciprocating piston compressor of the invention is for a gaseous medium and includes: a drive source including: a crankshaft having a crankshaft lug; a drive shaft for driving the crankshaft with the crankshaft lug; and, a crankcase assembly including: a crankcase connected to the drive source; a cylinder head; a cylinder-shaped component disposed between the cylinder head and the crankcase; the cylinder-shaped component having an inner cylinder running path defining a path longitudinal axis; a piston having a piston ring and being mounted in the cylinder-shaped component for carrying out a reciprocating movement therein; a connecting rod connected to the piston and to the crankshaft lug for imparting the reciprocating movement to the piston as the crankshaft and the crankshaft lug are driven by the drive shaft; at least one outlet opening with at least one outlet valve; at least one inlet opening with at least one inlet valve; the crankshaft lug passing through an upper reversal point and a lower reversal point as the crankshaft and crankshaft lug are driven by the drive shaft; the drive shaft defining a first rotation point and the crankshaft lug defining a second rotation point; a spatial axis intersecting the first rotation point and intersecting the second rotation point when the second rotation point passes through the upper reversal point; the piston ring defining a piston ring longitudinal axis; the piston ring longitudinal axis and the path longitudinal axis conjointly defining a pivot angle which varies with the reciprocating movement of the piston; the pivot angle having a maximum during the upward movement of the piston which is less than a maximum of the pivot angle during a downward movement of the piston; and, the path longitudinal axis being offset relative to the spatial axis.

The maximum pivot angle of the piston ring longitudinal axis relative to the longitudinal axis of the cylinder running path is less in the upward movement (compression stroke) than in the downward movement of the piston (intake stroke). The longitudinal axis of the cylinder running path is offset relative to the first spatial axis.

The pivot angle of the piston ring relative to the cylinder running path and therefore the piston ring longitudinal axis relative to the longitudinal axis of the cylinder running path is limited to a maximum permissible value with respect to deformation, pressure load and therefore tightness of the piston ring. This applies especially to the upward movement of the piston (the compression stroke) because increased requirements with respect to deformation, pressure load and therefore tightness are imposed on the contact location of the piston ring and the cylinder running path.

The advantage of the invention is especially that because of the above, the structural elevation of the reciprocating piston compressor can be reduced by a reduction of the connecting rod length and a correspondingly reduced length of the cylinder running path without impermissibly subjecting the piston ring to load and without exceeding the maximum permissible pivot angle in the compression stroke. The reduced structural elevation of the reciprocating piston compressor is achieved with a reduction of the connecting rod length and a corresponding reduction of the length of the cylinder running path. The longitudinal axis of the cylinder running path is offset relative to the first spatial axis so that the maximum pivot angle of the piston ring relative to the cylinder running path does not exceed the maximum permissible value in the compression stroke. A further advantage of the invention is especially that the maximum pivot angle during the intake stroke (where no increased requirements are imposed on the piston ring with respect to deformation, pressure load and tightness) is greater than the maximum permissible pivot angle which leads to a reduction of the friction and an improvement of the intake operation during the intake stroke.

According to another feature of the invention, the longitudinal axis of the cylinder running path is offset parallel relative to the first spatial axis. An advantage of this embodiment is that the longitudinal axis of the cylinder running path runs perpendicular to the longitudinal axis of the motor drive shaft which is easily manufactured. A further advantage of this embodiment is that the cylinder-shaped component is rotationally symmetrical and therefore is simple to manufacture especially from standard component parts.

According to another feature of the invention, the longitudinal axis of the cylinder running path does not intersect the rotation point of the drive shaft. An advantage of this embodiment is that the pivot angle of the piston ring relative to the cylinder running path can be adapted within a wide range especially in the compression stroke. The angle between the longitudinal axis of the cylinder running path and the first spatial axis can include a very wide range in that a very low or very high value is selected.

According to another feature of the invention, the longitudinal axis of the cylinder running path is pivoted relative to the first spatial axis. An advantage of this embodiment is that the pivot angle of the piston ring relative to the cylinder running path can be best adapted especially in the compression stroke and the maximum reduction of the structural elevation of the reciprocating piston compressor is achieved. A further advantage of this embodiment is that the pivot angle of the piston ring relative to the cylinder running path, especially in the compression stroke, moves over a largest possible distance of the compression and/or intake stroke within a region which is optimal with respect to the following: the tightness of the piston ring to the cylinder running path; the piston ring wear and/or the piston ring service life.

According to another feature of the invention, the longitudinal axis of the cylinder running path is pivoted relative to the first spatial axis by an angle between 0.5° and 7°. An advantage of this embodiment is that the maximum pivot angle of the piston ring relative to the cylinder running path, especially in the compression stroke, moves within the optimal range, especially 4° to 8°, with respect to the tightness of the piston ring to the cylinder running path and the piston ring wear and/or the piston ring service life.

According to another feature of the invention, the intersect point of the longitudinal axis of the cylinder running path with the first spatial axis lies in the region of the upward and downward movement of the piston within the cylinder running path. An advantage of this embodiment is that the reciprocating piston compressor can be configured to be very compact and an optimal utilization of the space for accommodating the component is provided.

According to another feature of the invention, the intersect point of the longitudinal axis of the cylinder running path with the first spatial axis lies in the center of the region of the upward and downward movement of the piston within the cylinder running path. An advantage of this embodiment is that the change of the amplitude of the pivot angle of the piston ring relative to the cylinder running path is very slight relative to the cylinder running path over the entire distance of the piston ring movement especially in the compression stroke. Another advantage of the invention is that the reciprocating piston compressor can be configured to very compact and an optimal utilization of space available for accommodating the component is provided.

According to another feature of the invention, the intersect point of the longitudinal axis of the cylinder running path with the first spatial axis lies in the upper change-of-direction or reversal point of the piston within the cylinder running path. An advantage of this embodiment is that the optimal pivot angle of the piston ring relative to the cylinder running path lies in the upper region of the compression stroke and therefore in the region of the highest load on the piston ring because of the high pressures during the compression stroke which become greater in correspondence to the compression.

According to another feature of the invention, the outlet opening with the material, which surrounds the outlet opening, dips at one end into the cylinder running path and the plane of the end piece, which is oriented toward the crankcase, runs perpendicular to the first spatial axis. An advantage of this embodiment is that the clearance or dead space is reduced in a simple manner and space for structures is saved.

According to another feature of the invention, the surface of the end piece of the cylinder head, which is oriented toward the crankcase, has a spherical or barrel-shaped contour and the outer surface of the curvature of the spherical or barrel-shaped contour is oriented toward the crankcase. In this way, the dead space is reduced and therefore the capacity and the efficiency of the reciprocating piston compressor is increased.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
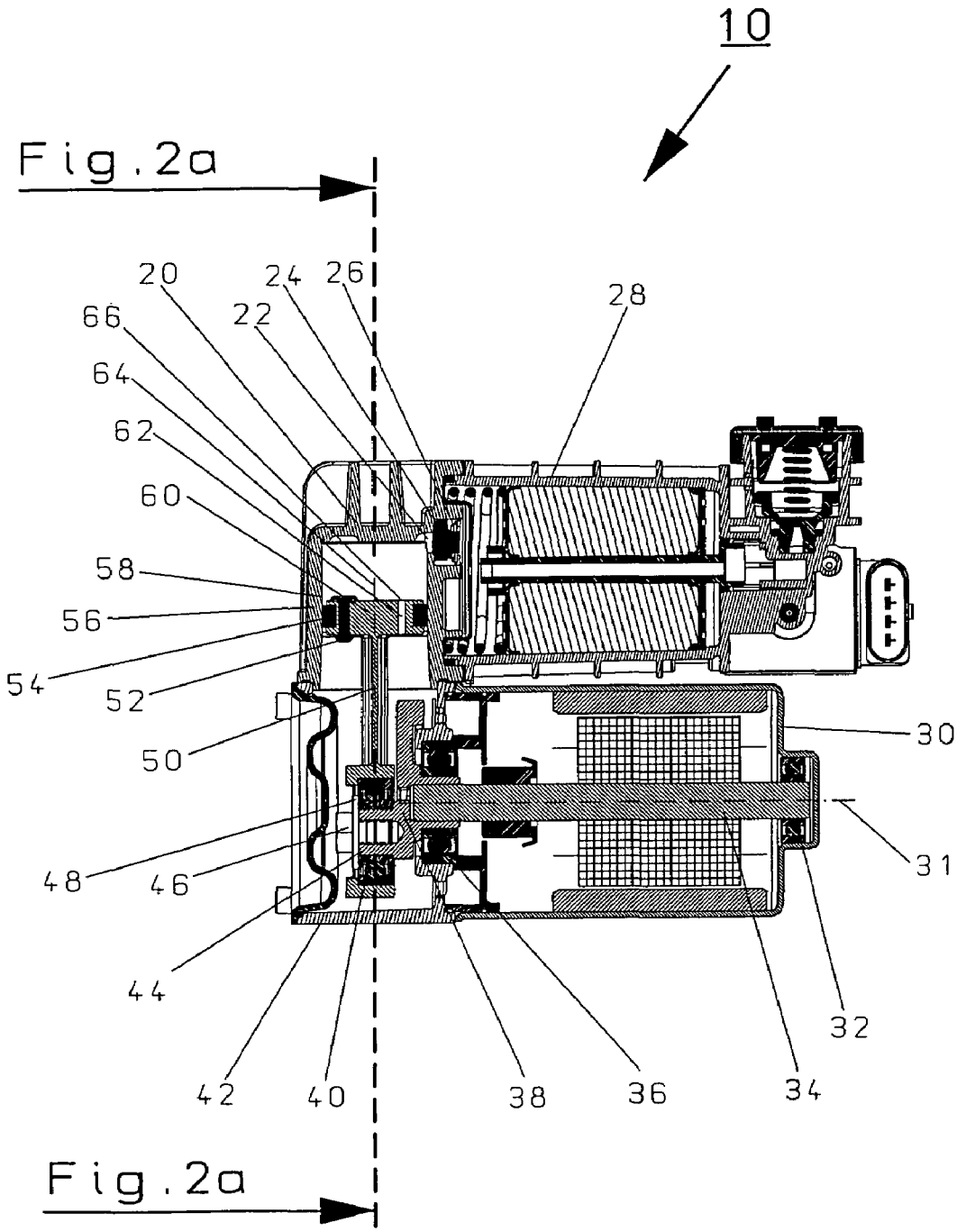
FIG. 1 is a side elevation view, in section, of a reciprocating-piston compressor; and, FIGS. 2 to 6 are schematics showing the kinematics of the reciprocating-piston compressor.

FIG. 1 shows a reciprocating-piston compressor 10 of conventional configuration. In this embodiment, the cylinder head 20 is configured as one piece with a cylinder-shaped component 56 and includes an outlet channel 22. The outlet channel 22 is closed toward the dryer housing 28 by an outlet valve 24 which consists of an elastomeric body, a leaf valve or the like. A valve spring 26 is attached in the cylinder head 20 and presses the outlet valve 24 when there is no or only a slight pressure drop on the valve seat of the outlet channel 22 and closes this channel to the dryer housing 28.

The cylinder-shaped component 56 includes a cylinder running path 58 having a high surface quality and is connected at one end to the crankcase 42. The cylinder head 20 and the cylinder-shaped component 56 can also be manufactured as separate components. Accordingly, and by way of example, the cylinder-shaped component 56 can be manufactured cost effectively from a standard component part such as a pipe. The cylinder head 20 is connected to the cylinder-shaped component 56 by means of a press connection or the like.

A crankshaft 38 is mounted in the crankcase 42 and is pressed with a lug into the inner race of a bearing 36. The outer race of the bearing 36 is attached to the crankcase. The crankshaft 38 includes a crankshaft lug 44 which functions to accommodate a bearing 40 and therefore a connecting rod 50. The bearing 40 is fixedly connected to the connecting rod 50 and is fixed to the crankshaft lug 44 via a screw 46 and a disc or washer 48. The connecting rod 50 defines a longitudinal axis 64 which, in this embodiment, is coincident with the longitudinal axis of a piston 60, which is fixedly connected to the connecting rod 50, and the longitudinal axis of a piston ring 54 fixed in the piston 60. The piston 60 and/or the piston ring 54 can, however, also have a longitudinal axis different from the longitudinal axis 60 of the connecting rod 50. The piston 60 together with the connecting rod 50 is configured as a so-called pendular piston, that is, the piston 60 is rigidly connected to the connecting rod 50.

In the piston, an inlet channel 62 is provided which connects the compression chamber with the space toward the crankcase 42. The inlet channel 62 is closed with the upward movement of the piston 60 (compression stroke) by an inlet valve 66 so that no air can flow from the compression chamber to the interior space of the crankcase 42 and the inlet channel 62 is opened with the downward movement of the piston 60 (intake stroke) so that air can flow from the interior space of the crankcase 42 to the compression chamber. It is, however, conceivable that the inlet channel 62 and therefore also the inlet valve 66 are arranged in the cylinder head 20. As this embodiment shows, the inlet valve 66 can also be configured as a leaf valve or as an elastomeric valve body with or without a valve spring as known per se.

The symmetry axis of the bearing 36 is coincident with a drive axis 31 of a drive shaft 34 of the drive unit. The drive shaft 34 is connected fixedly to the crankshaft 38. In this embodiment, the drive unit is an electric motor. The use of every other known drive unit such as a pneumatic or hydraulic drive is possible. The drive shaft 34 of the electric motor is journaled at one end in the bearing 36 and, at the other end, in a bearing 32. The bearing 32 is fixed in a motor housing 30 which is fixedly connected to the crankcase 42.

Figure 2:
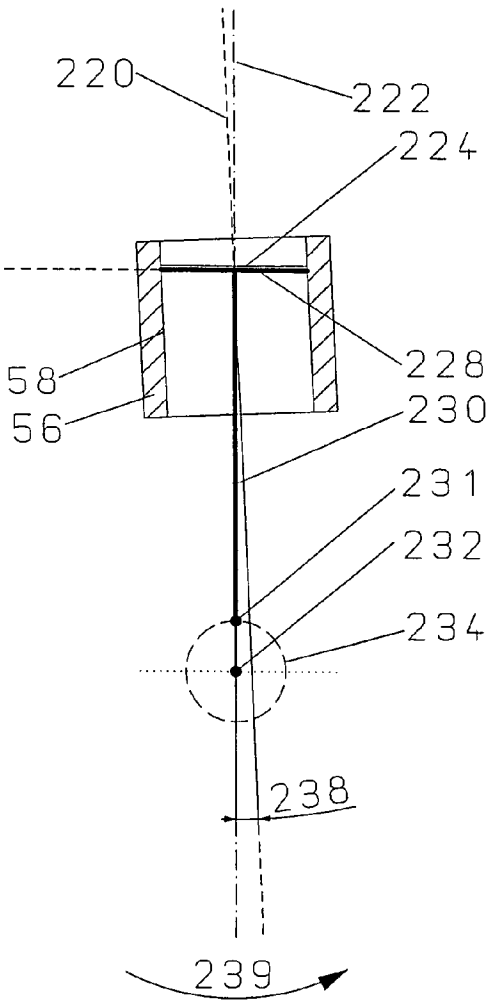
Figure 2A:
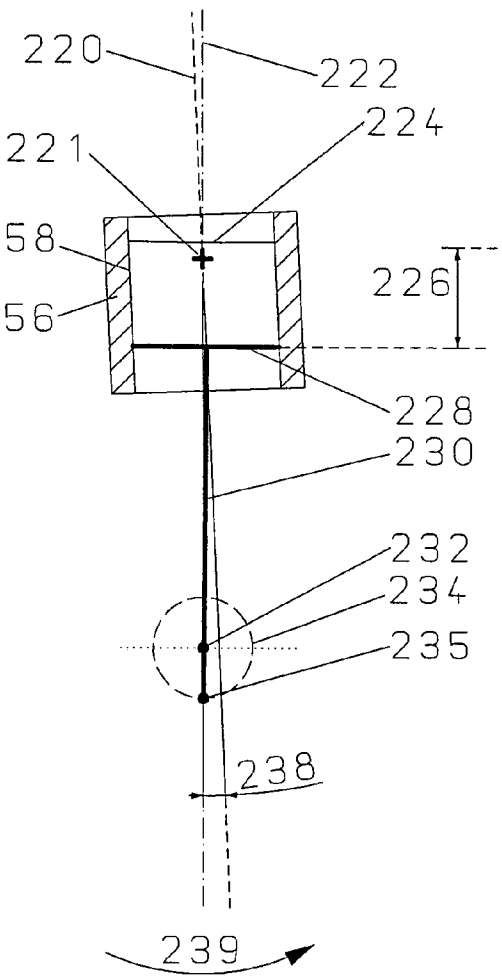

FIGS. 2 and 2*a* show schematically the kinematics of a reciprocating piston compressor. A schematic representation of a piston 228 and a schematic of a connecting rod 230 are shown at top dead center of the piston 228 in FIG. 2. In this position, a rotation point of the crankshaft lug 44 (see FIG. 1) is also at the upper change-of-direction or reversal point 231. A first spatial axis 222 intersects the upper reversal point 231 of the crankshaft lug 44 (see FIG. 1) and a rotation point 232 of the drive axis 31 (see FIG. 1). A longitudinal axis 220 of the cylindrically-shaped component 56 and the cylinder running path 58 does not intersect the rotation point 232 of the drive axis 31 (see FIG. 1); instead, it is pivoted by an angle 238 relative to the first spatial axis 222. Preferably, the pivot angle 238 lies in a range of between 0.5° and 70°.

The rotation point of the crankshaft lug 44 (see FIG. 1) passes through a movement circle 234 with a rotation of 360° about the rotation point 232 of the drive axis 31 (see FIG. 1). This movement circle 234 has a radius which corresponds to the eccentricity of the crankshaft 38 (see FIG. 1). The direction 239 of movement of the rotation point of the crankshaft lug 44 (see FIG. 1) runs counterclockwise. Between the upper end of the piston 228 and the surface of the cylinder head 224, the smallest possible gap is present which defines the dead volume of the reciprocating piston compressor. The surface of the cylinder head 224 is perpendicular to the first spatial axis 222. Likewise, an inclined position of this surface to the first spatial axis 222 is possible, for example, the surface of the cylinder head 224 can run perpendicular to the longitudinal axis of the cylinder running path so that the dead volume is held as small as possible.

FIG. 2*a* likewise schematically shows the kinematics of a reciprocating piston compressor. The piston 228 is shown at bottom dead center. The crankshaft lug 44 (see FIG. 1) is in its lower change-of-direction or reversal point 235. In this way, the range of movement 226 of the piston 228 extends from the lower end of the piston 228 at bottom dead center to the top end of the piston 228 at top dead center. The intercept point 221 of the longitudinal axis 220 of the cylindrical travel path 58 and the first spatial axis 222 lies within the cylinder running path and within the movement region 226 of piston 228.

Figure 3:
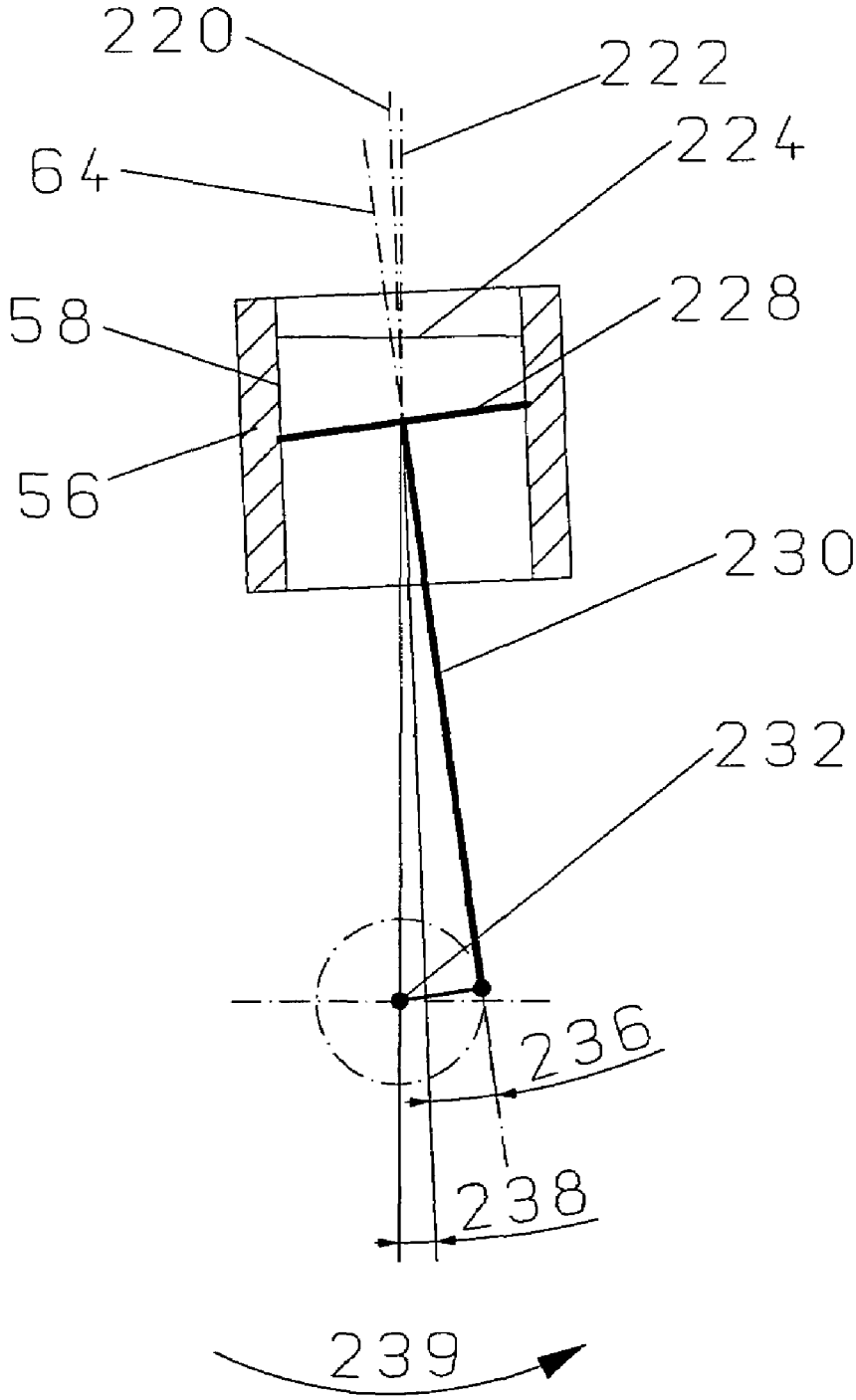

FIG. 3 shows the piston 228 and the connecting rod 230 in the maximum pivot position in the compression stroke. Preferably, the crankshaft (connection of the rotation point of the drive axis 232 to the rotation point of the crankshaft lug) is perpendicular to the longitudinal axis 64 of the connecting rod 230. The longitudinal axis 64 of the piston ring (not shown) has a pivot angle 236 relative to the longitudinal axis 220 of the cylinder running path 58. In this embodiment, the longitudinal axis 64 of the piston ring is identical to the longitudinal axis of the piston 228 and of the connecting rod 230. The pivot angle 236 corresponds to the maximum pivot angle of the piston ring to the cylinder running path 58 in the compression stroke.

Figure 4:
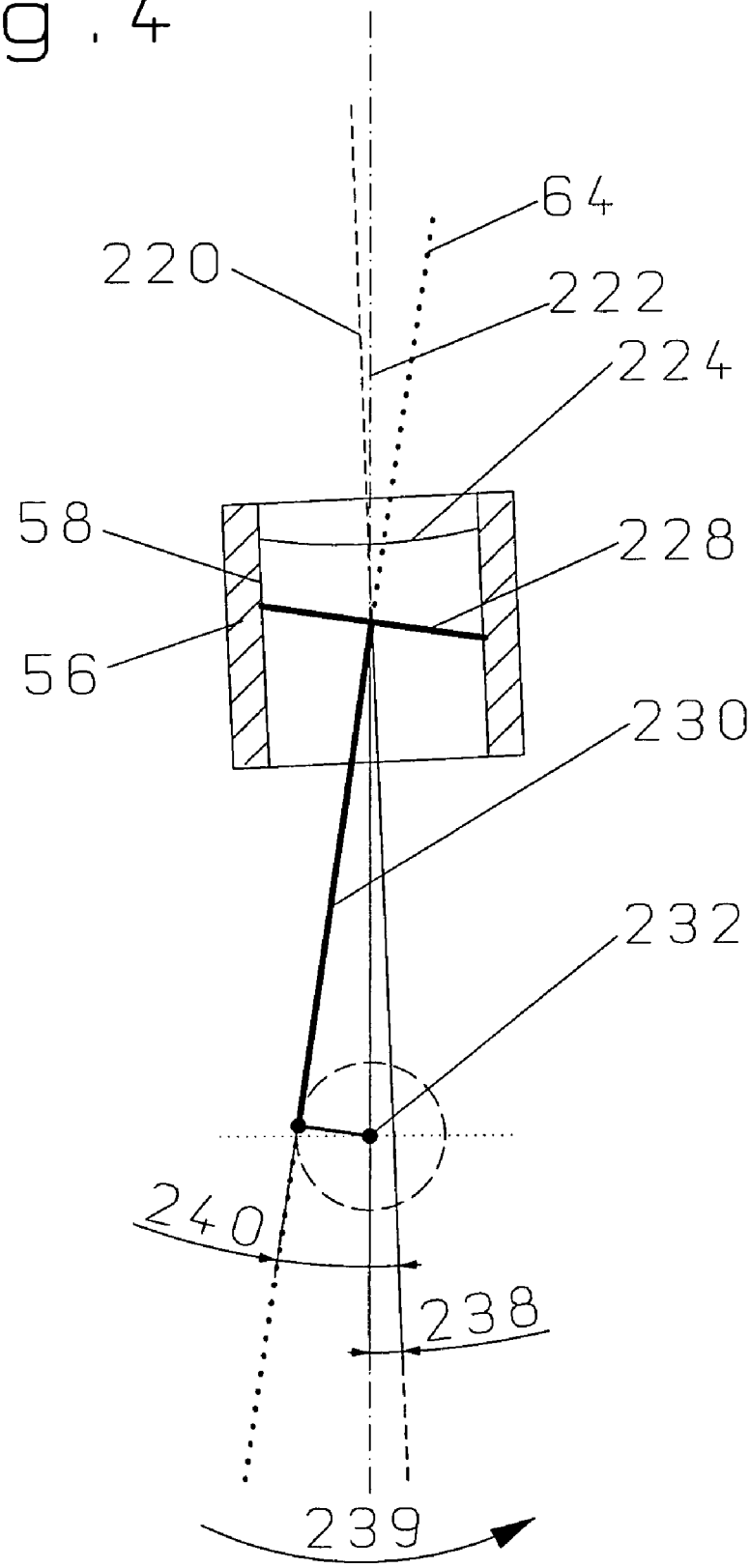

FIG. 4 shows the piston 228 and the connecting rod 230 in the maximum pivot position in the intake stroke. Preferably, the crankshaft (connection of rotation point of the drive axis 232 to the rotation point of the crankshaft lug) is perpendicular to the longitudinal axis 64 of the connecting rod 230. The longitudinal axis 64 of the piston ring (not shown) is at a pivot angle 240 relative to the longitudinal axis 220 of the cylinder running path 58. In this embodiment, the longitudinal axis 64 of the piston ring is identical to the longitudinal axis 64 of the piston 228 and of the connecting rod 230. The pivot angle 240 corresponds to the maximum pivot angle of the piston ring relative to the cylinder running path 58 in the intake stroke. As shown in FIGS. 3 and 4, the maximum pivot angle 236 in the compression stroke is less than the maximum pivot angle 240 in the intake stroke.

Figure 5:
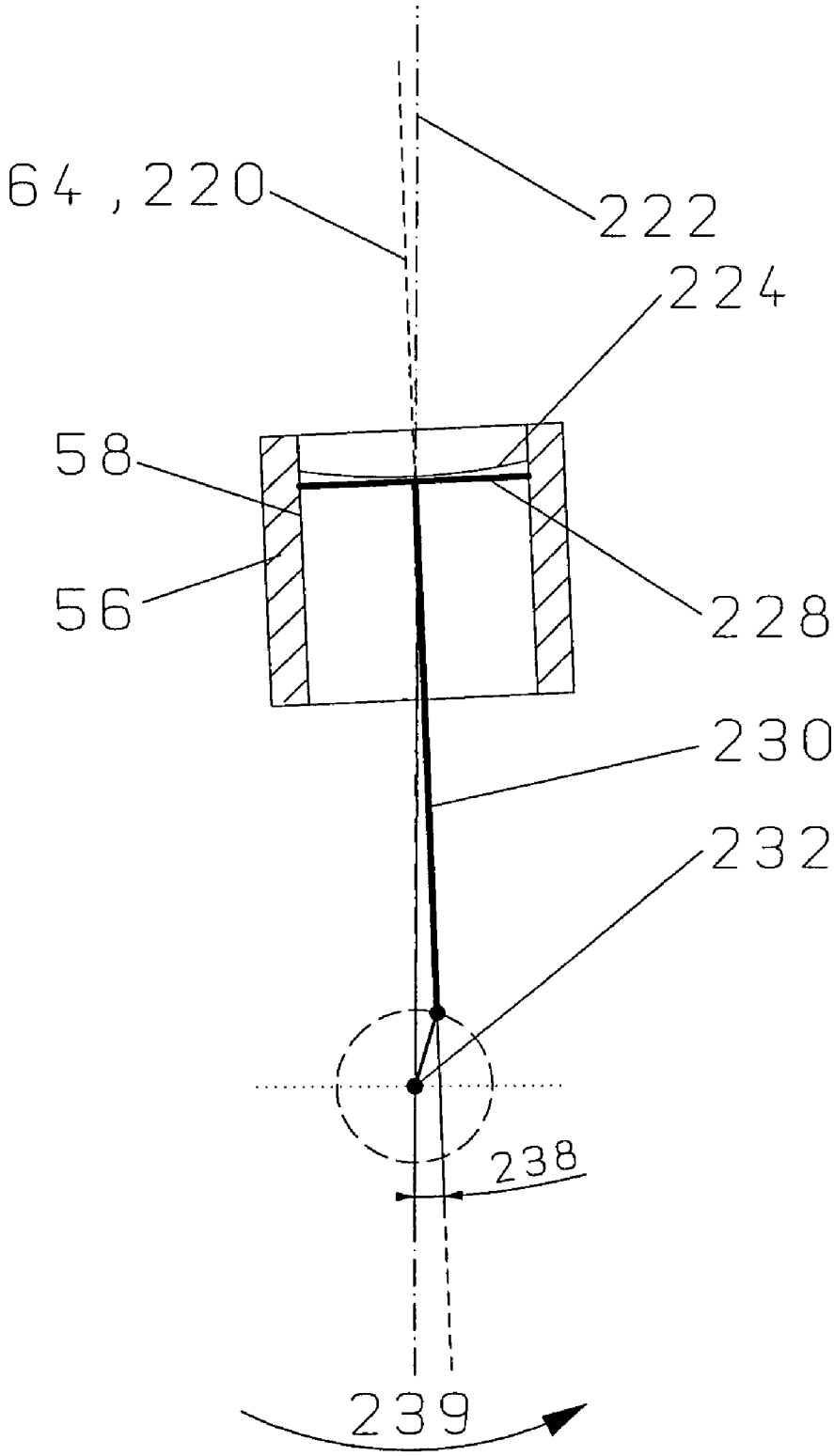

FIG. 5 shows the piston 228 and the connecting rod 230 in a position during the compression stroke shortly ahead of top dead center. The longitudinal axis 64 of the piston ring, of the piston 228 and/or of the connecting rod 230 is identical to the longitudinal axis 220 of the cylinder running path 58 at the time point shown in FIG. 5. In this embodiment, the surface of the cylinder head 224 facing toward the piston 228 is configured to be round or cylindrically shaped. The outer contour of the rounding of the surface 224 faces in the direction of the piston so that the dead volume is as small as possible. The center point of the rounding or the longitudinal axis of the cylinder of the surface 224 lies on or intersects preferably the longitudinal axis 220 of the cylinder running path 58. It is, however, conceivable that the first spatial axis 222 or a further axis intersects the center point of the rounding or the longitudinal axis of the cylinder of the surface 224.

Figure 6:
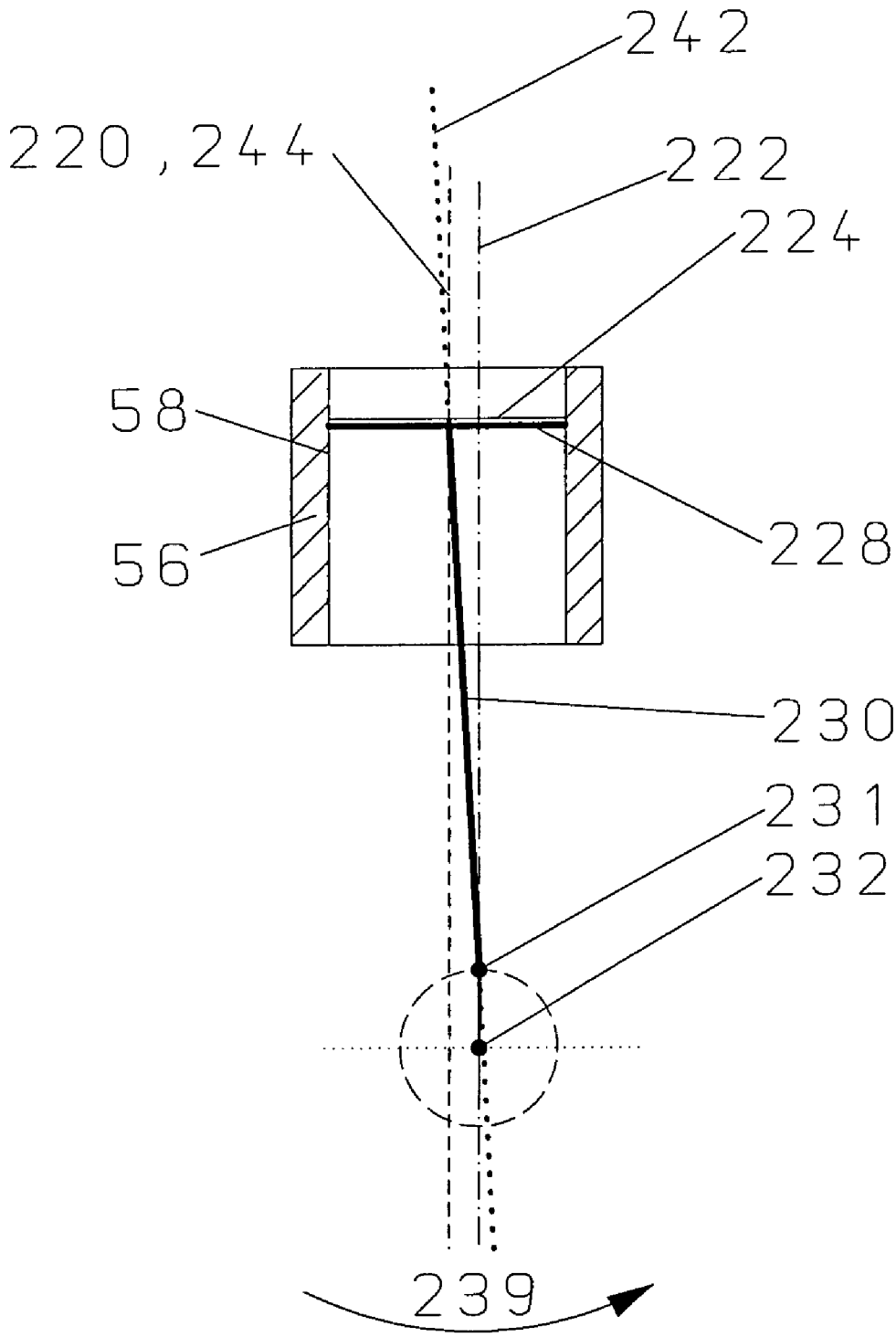

FIG. 6 shows schematically the kinematics of an embodiment of a reciprocating piston compressor wherein the longitudinal axis 220 of the cylinder running path 58 is offset parallel relative to the first spatial axis 222 and does not intersect the rotation point 232 of the drive axis 31 (see FIG. 1). Preferably, as shown here, the cylindrically-shaped component 56 is also offset parallel to the first spatial axis. The parallel offset of the longitudinal axis 220 to the first spatial axis 222 can either be so made that the longitudinal axis 242 of the connecting rod 230 coincides with the longitudinal axis 220 of the cylinder running path 58 in two points during the intake stroke (as shown) or in two points during the compression stroke.

Preferably, with the parallel offset of the longitudinal axis 220 to the first spatial axis 222, the longitudinal axis 242 of the connecting rod 230 and the longitudinal axis 244 of the piston 228 and/or the piston ring are not identical. The axis 244 of the piston 228 and/or of the piston ring have another pivot angle relative to the longitudinal axis 220 of the cylinder running path 58 than the longitudinal axis 242 of the piston rod 230. In this embodiment, the longitudinal axis

220 of the cylinder running path 58 is coincident with the longitudinal axis 244 of the piston or the piston ring at top dead center so that a very small dead volume occurs. The pivot angle and therefore the pivoting of the longitudinal axis 244 of the piston ring relative to the longitudinal axis 220 of the cylinder running path 58 can, for example, be aligned to a small maximum or to a small amplitude especially during the compression stroke.

It is understood that the foregoing description is that of the preferred embodiments of the invention and that various changes and modifications may be made thereto without departing from the spirit and scope of the invention as defined in the appended claims.

What is claimed is:

1. A reciprocating piston compressor for a gaseous medium, comprising: a drive source including: a crankshaft having a crankshaft lug; a drive shaft for driving said crankshaft with said crankshaft lug; and, a crankcase assembly including: a crankcase connected to said drive source; a cylinder head; a cylinder-shaped component disposed between said cylinder head and said crankcase; said cylinder-shaped component having an inner cylinder running path (58) defining a path longitudinal axis (220); a piston having a piston ring and being mounted in said cylinder-shaped component for carrying out a reciprocating movement therein; a connecting rod connected to said piston and to said crankshaft lug for imparting said reciprocating movement to said piston as said crankshaft and said crankshaft lug are driven by said drive shaft; at least one outlet opening with at least one outlet valve; at least one inlet opening with at least one inlet valve; said crankshaft lug passing through an upper reversal point (231) and a lower reversal point (235) as said crankshaft and crankshaft lug are driven by said drive shaft; said drive shaft defining a first rotation point (232) and said crankshaft lug defining a second rotation point (231,234,235); a spatial axis (222) intersecting said first rotation point (232) and intersecting said second rotation point when said second rotation point passes through said upper reversal point (231); said piston ring defining a piston ring longitudinal axis (64); said piston ring longitudinal axis (64) and said path longitudinal axis (220) conjointly defining a pivot angle (236,240) which varies with said reciprocating movement of said piston (228); said pivot angle having a maximum during the upward movement of said piston (236) which is less than a maximum of said pivot angle during a downward movement (240) of said piston; and, said path longitudinal axis (220) being offset relative to said spatial axis (222), wherein said path longitudinal axis (220) is pivoted relative to said spatial axis (222), and wherein said cylinder head has an end piece oriented toward said crankcase; and said end piece has a surface facing toward said crankcase, and said surface has a spherical-like or barrel-like contour.

2. The reciprocating piston compressor of claim 1, wherein said path longitudinal axis (220) is pivoted relative to said spatial axis (222) by an angle between 0.50° and 10°.

3. The reciprocating piston compressor of claim 1, wherein said path longitudinal axis (220) and said spatial axis (222) intersect in the region (226) of the reciprocating movement of said piston (228) within said cylinder running path (58).

4. The reciprocating piston compressor of claim 3, wherein said path longitudinal axis (220) and said spatial axis (222) intersect at the center of the region (226) of said reciprocating movement of said piston within said cylinder running path (58).

5. The reciprocating piston compressor of claim 3, wherein said path longitudinal axis (220) and said spatial axis (222) intersect at the top dead center point of said piston within said cylinder running path (58).

* * * * *